US005791965A

United States Patent [19]

Kim

[11] Patent Number: 5,791,965

[45] Date of Patent: Aug. 11, 1998

[54] LIGHT EMITTING APPARATUS FOR STUFFED TOYS AND THE LIKE

[75] Inventor: Duk Soo Kim, Seoul, Rep. of Korea

[73] Assignee: Great American Fun Corp., Columbus, Ohio

[21] Appl. No.: 484,732

[22] Filed: Jun. 7, 1995

[51] Int. Cl.[6] ..... A63H 33/22; A63H 3/28

[52] U.S. Cl. ..... 446/219; 446/485; 446/297

[58] Field of Search ..... 446/219, 297, 446/394, 485; 362/808

[56] References Cited

U.S. PATENT DOCUMENTS

| | | | |
|---|---|---|---|
| 4,622,771 | 11/1986 | Spengler | 446/219 X |
| 4,820,233 | 4/1989 | Weiner | 446/303 |
| 4,828,527 | 5/1989 | Spector | 446/219 X |
| 5,279,514 | 1/1994 | Lacombe et al. | 446/297 |
| 5,288,259 | 2/1994 | Konta et al. | 446/219 |

FOREIGN PATENT DOCUMENTS

| | | | |
|---|---|---|---|
| 4361779 | 12/1992 | Japan | 446/219 |

*Primary Examiner*—Mickey Yu

*Attorney, Agent, or Firm*—Porter, Wright, Morris & Arthur

[57] ABSTRACT

A stuffed toy is provided with a spaced array of lights on its outer surface. The light is emitted from outwardly disposed free ends of optical fibers of varying lengths. The frequency and intensity of the light is synchronized with sounds, music and/or words emitted when the toy is squeezed in the area where a switch is located. The squeeze switch, a battery housing and a speaker are located in the batting material inside the toy and are electrically connected to an integrated circuit also housed in the batting. A microchip is mounted on the printed circuit board and produces light-generating signals and audio-generating signals. An LED lamp receives the light-generating signals. The optical fibers have adjacent ends which are clamped together in a lamp-conforming configuration. The adjacent ends of the optical fibers and the LED lamp are encapsulated and secured in fixed relation to one another within the batting.

6 Claims, 1 Drawing Sheet

LIGHT EMITTING APPARATUS FOR STUFFED TOYS AND THE LIKE

BACKGROUND OF THE INVENTION:

The present invention relates to low amperage light producing and distributing apparatus for stuffed toys and novelty items, and more particularly to those which provide an array of lights.

Stuffed toys which speak, sing and/or emit sounds imitative of familiar farm or zoo animals are well known. See, e.g., U.S. Pat. No. 5,211,282, which discloses a sound module adapted to activate the sound-generating components disposed therein when the toy is squeezed. Stuffed toys provided with mechanized limbs are also found in the art. See, e.g., U. S. Pat. No. 5,374,216 which discloses a toy equipped with mechanized limbs, as well as sound generating components. There are also examples, perhaps more rare, of stuffed toys equipped with light emitting components. U. S. Pat. No. 4,734,074 discloses a resilient, animal-shaped toy whose eyes are provided with light bulbs or LED devices.

Some of the problems which the present inventor confronted were the heat generated by filamentous light bulbs and the cost of LED devices. These problems would not be particularly significant if only a few of the foregoing devices would suffice; however, the present inventor envisioned a stuffed toy equipped with an array of lights. In the inventor's view, a multiplicity of light bulbs would produce a dangerous amount of heat and a multiplicity of LED devices would be prohibitively expensive. Other problems were the relative hardness and fragility of conventional light producing devices. Typically, a smooth, transparent and relatively hard plastic shell covers a conventional low amperage light emitting device. The feel of this protective cover was, in the inventor's opinion, incompatible with an otherwise soft and cuddly stuffed toy. Furthermore, in spite of its hardness, the protective cover was believed to be insufficient to prevent damage to the light emitting device if the stuffed toy were placed in the hands of an angry, or simply curious, child.

SUMMARY AND OBJECTS OF THE INVENTION:

The present light emitting apparatus is adapted for use with a stuffed toy or novelty item and basically comprises an LED lamp, a conductor for supplying an electrical signal to the LED lamp, a plurality of elongated and flexible optical fibers of varying lengths, a device for holding adjacent ends of the optical fibers together in a lamp-conforming configuration, and a device for encapsulating and securing the LED lamp and the adjacent ends of the optical fibers in fixed relation to one another.

Primary objects of the present invention are to provide an array of lights on a stuffed toy or novelty item, to provide a light emitting assembly which is durable, cost effective and safe, to provide a light emitting assembly which is synchronously responsive to sounds also produced by the stuffed toy or novelty item and to provide a light emitting assembly whose exterior portions are soft to the touch.

Figure 1:
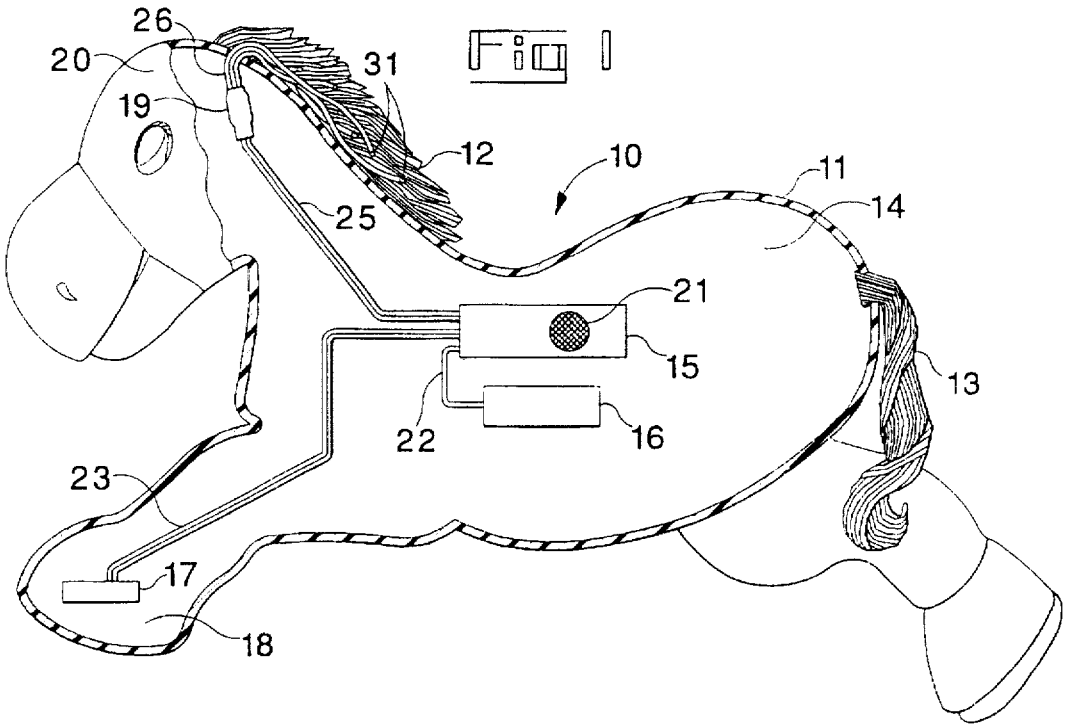
FIG. 1 is a sectional, diagrammatic view of a stuffed toy equipped with light emitting apparatus according to the present invention, a control/sound module, a battery housing and a squeeze switch.

DETAILED DESCRIPTION OF THE PREFERRED EMBODIMENT:

As illustrated in FIG. 1, a stuffed toy pony 10 embodying the present invention is provided with an outer fabric cover 11 of knitted acrylic plush material, preferably 7 mm thick, semi-dull, 750 gr. per yard and in three colors. The pony's mane 12 and tail 13 are formed from waved acrylic fibers. The pony 10 is stuffed with polyester batting 14. Positioned within the batting 14 in the abdominal region of the pony is a control/sound module 15 and a battery housing 16. A squeeze switch 17 is located in the batting in one of the pony's front hooves 18, and a light generating assembly 19 is positioned in the batting in the pony's upper head and neck region 20.

Housed within the control/sound module 15 is a printed circuit board upon which are mounted a microchip, two transistors, three resistors, a ceramic capacitor and a speaker 21. In a manner well known in the art, the microchip is programmed to provide audio-generating signals corresponding to selected animal sounds, music and/or words, and to provide light-generating signals which are synchronized with the audio signals. The light signals are synchronized in the sense that their frequency and duration bear a logical relationship to the audio signals, as described by example below. Once amplified, the audio-generating signals are channelled to the speaker 21, and the light-generating signals are channelled to the light producing assembly 19.

The battery housing 16 contains conductive mountings for two AA batteries and a nonconductive partition extending between the batteries. The conductive mountings are electrically connected in conventional fashion to the circuit board in the control/sound module 15 by a cable 22.

The squeeze switch 17 comprises a compressible outer housing, springs or other resilient members which bias the housing to an uncompressed position, a plate provided with a conductive grid and a flexible, resilient dome-like structure secured over the grid and provided with a conductive disc. When the user squeezes the pony's hoof 18, the switch housing 17 is compressed, thereby bringing the conductive disc into contact with the grid and momentarily closing the circuit. The grid is electrically connected to the circuit board in the control/sound module 15 by a cable 23. When the circuit is closed, the battery voltage is applied to the circuit board, the selected sounds, music and/or words are emitted from the speaker 21 and light emanates from the pony in the manner described below.

Figure 2:
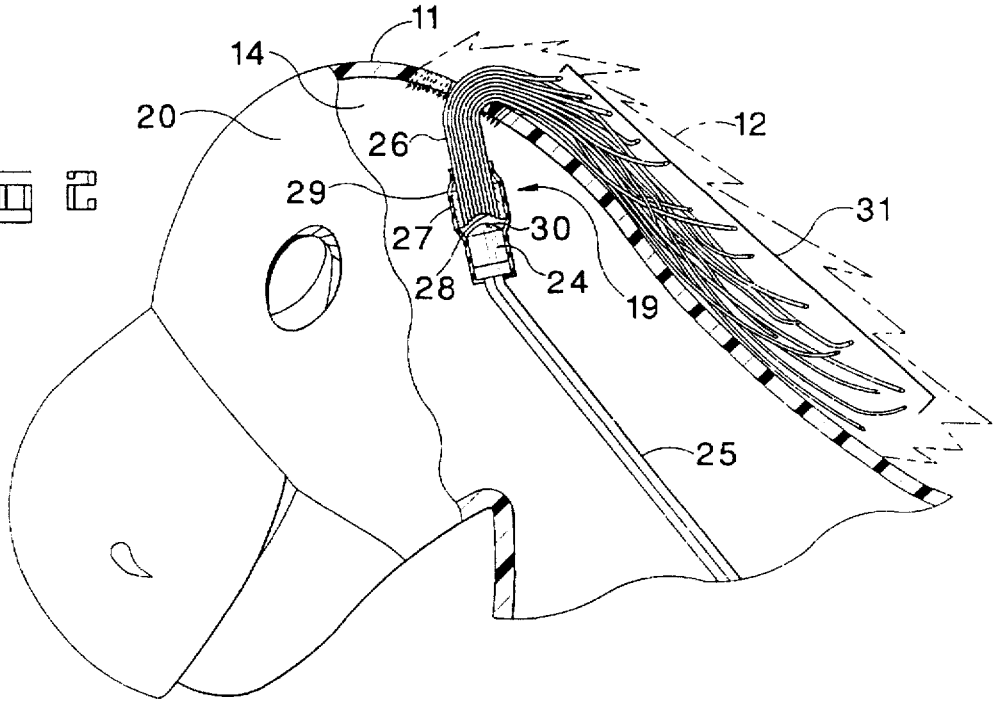
FIG. 2 is an enlarged, fragmentary sectional view of the toy illustrated in FIG. 1 and particularly illustrates the preferred embodiment of the present light emitting apparatus.

As illustrated in FIG. 2, the light emitting apparatus, generally designated 19, basically comprises an LED lamp 24, a conductor 25 for supplying the light-generating electrical signals to the LED lamp, a plurality of elongated and flexible optical fibers 26 of varying lengths, a clamp 27 for holding adjacent ends 28 of the optical fibers together in a lamp-conforming configuration, and a sleeve 29 for encapsulating and securing the LED lamp 24, the clamping device 27 and the adjacent ends 28 of the optical fibers 26 in fixed relation to one another.

The LED lamp 24 is preferably an SR5312-U and emits red light in a broader intensity range than the typical LED output. The lamp 24 is responsive to the light-generating signals produced by the integrated circuit components in the control/speaker module 15 and carried by the two-wire cable 25. The lamp is adapted to provide variable blushing, brightness and flashing outputs in response to variations in the IC signals.

The clamp 27 is cylindrical and is preferably made from brass plated copper. The optical fibers 26 are arranged so that one end of each fiber is adjacent to one end of several other fibers, whereupon the relative positions of the fibers are adjusted so that the bundle of ends 28 conforms in shape to the contour of the output end 30 of the LED lamp 24. The clamp 27 is then applied to the bundle 28 to maintain the desired lamp-conforming shape.

The sleeve 29 is formed from heat shrinkable PVC and is fitted over the lamp 24, the clamp 27 and the bundled end 28 of the fibers. The bundled ends 28 of the optical fibers and the output end 29 of the lamp are positioned in closely spaced relation to one another, and heat is applied to the sleeve 29. As the sleeve shrinks, it conforms to the shapes of, encapsulates and secures the components housed therein in fixed relation to one another.

The optical fibers 26 are uniformly transparent, elongated synthetic resin cylinders of uniform diameter and possess high grade tensile strength and flexibility. There is, however, variation in the lengths of the fibers. The bundle of fibers 26 extends from the sleeve 29 through the batting 14 and emerges from the outer fabric cover 11 at a position slightly below the top of the pony's mane 12. The optic fiber bundle is sewn or otherwise secured to the outer cover at or near the point of emergence, and from this point to their free ends 31, the fibers are intertwined with the opaque synthetic fibers of the mane 12. The light produced by the LED lamp 24 is transmitted by successive reflection within each optical fiber and emerges at their free ends 31 dispersed in the mane. Since the optic fibers vary in length, a spaced array of lights is provided in the pony's mane.

As previously indicated, the microchip in the control/sound module 15 is programmed to provide light-generating signals which are synchronized in some logical fashion with its audio-generating signals. For example, the light signals may cause the LED lamp 24 and, by optical transmission, the free ends 31 of the fibers to flash on and off in time to the rhythm of the sounds, music and/or words emitted by the audio speaker 21. Alternatively, or in addition, the light signals may cause the lamp and the free fiber ends to emit a blush or softer light during relatively lower register or slower passages in the audio portion and a relatively brighter light during higher register or rapid sound episodes.

In the foregoing manner, the present light-emitting apparatus enhances the play value of a child's stuffed toy or novelty item and does so in a safe, cost effective, durable and attractive manner.

While a single preferred embodiment of the present invention has been illustrated and described in detail, the foregoing disclosure is not intended to unduly limit or restrict the spirit of the invention or the scope of the following claims.

I claim:

1. A stuffed toy comprising:

an LED lamp;

a conductor for supplying a light-generating electrical signal to the LED lamp;

a plurality of elongated and flexible optical fibers of varying lengths;

means for holding adjacent ends of the optical fibers together in a lamp-conforming configuration;

means for encapsulating and securing the LED lamp and the adjacent ends of the optical fibers in fixed relation to one another;

batting material disposed in surrounding relation to the LED lamp, the conductor, said means for holding, said means for encapsulating and securing and a portion of each of the optical fibers;

a fabric cover surrounding the batting material; and said optical fibers having free ends disposed in a spaced array outwardly of the fabric cover.

2. The stuffed toy according to claim 1, which further comprises means for producing the light-generating electrical signal, said means for producing the light-generating signal being substantially surrounded by the batting material.

3. The stuffed toy according to claim 2, wherein the means for producing the light-generating signal also produces an audio-generating signal and wherein a speaker is substantially surrounded by the batting material and is electrically connected to the means for producing the audio-generating signal.

4. The stuffed toy according to claim 3, wherein the means for producing the light-generating electrical signal synchronizes the light-generating electrical signal with the audio-generating electrical signal.

5. The stuffed toy according to claim 3, which further comprises battery means electrically connected to the means for producing the light-generating electrical signal, said battery means being housed within the batting material.

6. The stuffed toy according to claim 5, which further comprises switch means electrically connected to the means for producing the light-generating electrical signal, said switch means being housed within the batting material.

* * * * *